United States Patent [19]

Hedger

[11] 3,974,744

[45] Aug. 17, 1976

[54] ENGINES, OR PRIME MOVERS

[76] Inventor: John Henry Hedger, P.O. Box 357, Lakeside, Calif. 92040

[22] Filed: Dec. 4, 1974

[21] Appl. No.: 529,262

Related U.S. Application Data

[63] Continuation of Ser. No. 336,027, Feb. 26, 1973, abandoned.

[52] U.S. Cl. ..... 91/454; 92/34

[51] Int. Cl.[2] ..... F15B 11/08; F15B 13/04

[58] Field of Search ..... 91/454, 457; 92/34, 92/47; 123/191 T, 193 P, 193 R; 417/492; 251/335 A

[56] References Cited

UNITED STATES PATENTS

| | | | |
|---|---|---|---|
| 862,867 | 8/1907 | Eggleston | 417/472 X |
| 863,545 | 8/1907 | MacLachlan | 123/191 T |
| 1,032,470 | 7/1912 | Denneen et al. | 251/335 A |
| 1,181,802 | 5/1916 | Rogge | 123/193 R |
| 1,726,584 | 9/1929 | Persons | 92/45 |
| 1,894,667 | 1/1933 | Church et al. | 123/191 T |
| 1,905,583 | 4/1933 | Giesler | 92/47 |
| 2,096,066 | 10/1937 | Saforcada | 92/47 X |
| 2,358,032 | 9/1944 | Rothwell et al. | 92/34 X |
| 2,698,025 | 12/1954 | Jordan | 92/34 X |
| 2,934,900 | 5/1960 | Robinson | 92/34 X |
| 3,055,219 | 9/1962 | Wilson et al. | 92/34 X |
| 3,221,609 | 12/1965 | Frantz | 91/363 R |
| 3,861,277 | 1/1975 | Wagner et al. | 92/34 |

*Primary Examiner*—Irwin C. Cohen
*Attorney, Agent, or Firm*—Frank D. Gilliam

[57] ABSTRACT

An engine, or prime mover, utilizing the various expansion properties of a gas or fluid, hereinafter termed the "working fluid", for converting the pressures associated with said expansion properties into useful work. The engine having a "piston" and "cylinder" arrangement, with suitable valves, camshafts, etc., whereby expansion of the working fluid moves the "piston" exhibiting kinetic energy in accordance with the magnitude of the kinetic effects on the piston.

4 Claims, 1 Drawing Figure

ENGINES, OR PRIME MOVERS

This is a continuation of application Ser. No. 336,027, filed Feb. 26, 1973, and now abandoned.

BACKGROUND OF THE INVENTION

Subject invention relates generally to engines, or prime movers, and more particularly to engines utilizing expanding fluids or gasses as the power-producing medium, or working fluid, such as gasoline engines or steam engines.

Historically engines of the expanding fluid type suffer from difficulties in lubrication between the piston and cylinder walls. Oil sumps are used and splash or pressure systems carry the oil from the sump to the cylinder walls in the path of the advancing piston. This oil bath of the cylinder walls serves both to carry heat away from the cylinder and to lubricate. Then special oil rings, or oil "wipers" are placed on the piston to scrape away excess oil and thus attempt to keep oil from gaining admission to the cylinder area on the "power" side of the piston. Then "compression" rings are placed on the piston in an attempt to prevent leakage of the working fluid past the cylinder walls and into the oil sump, and for other reasons. It follows, then, that special and expensive materials, machining, etc., are employed to effect these requirements and the tolerances that must be held are very close.

Furthermore, in low-temperature engines of today utilizing the expansion properties of fluids which have a "low-temperature" boiling point, or using gasses at the optimum portion of the temperature/expansion or pressure/expansion curves, considered "low-temperature" devices in relation to the usual operating temperatures of the so-called "gasoline" engines, the fluids or gasses utilized are frequently solvents of greases oils, thus adding to the difficulties by the possibility of "freezing" or siezing of the piston within the cylinder walls.

Moreover, in the case of the steam engine, for example, steam, water and oil may mix together, thus requiring special and expensive articles of equipment such as oil seperators, dehydrators, etc., in an attempt to keep the overall system from being contaminated by, in areas where they apply, oil, steam, water, etc.

SUMMARY OF THE INVENTION

The instant invention overcomes the problems heretofore encountered and as set forth above. The engine of the instant invention requires no lubrication nor cooling of the cylinder-piston assembly at any time. The engine of the instant invention utilizes a housing and bellows arrangement, the bellows being fabricated integrally with said housing and inside of said housing, thus leakage of the working fluid is not possible. A power transfer mechanism, or "piston rod" is suitably attached to the top of the bellows and extends from within the bellows to some suitable arrangement outside the bellows/housing assembly, such as a crosshead, etc., in the usual manner. The compression side of the bellows is completely enclosed within the housing or cylinder, in such manner that the space around the outside and head of the bellows is sealed. Through the use of adequate valving, etc., the working fluid is introduced into said space around the outside of the bellows, causing the bellows to move in compression. When it is desired to release pressure around the bellows a suitable exhaust valve is opened, when the bellows may then be allowed to return to its normally expanded position. The said bellows is specially fabricated, using inexpensive and readily available materials, both for the bellows and the tooling therefor and is the subject matter for a further application for letters patent.

Thus, by proper operation and timing of the valves, and other parts, the engine becomes a continuous operating reciprocating engine, or a pulsating engine, as desired.

It is therefore an object of this invention to provide an engine, or prime mover, which eliminates the need for lubrication of the cylinder walls, or heat transfer from said cylinder walls.

It is another object of this invention to provide an engine which permits of no leakage of the working fluid throughout, including valves, etc., and does, in fact, seal all parts of the engine against leakage.

It is a further object of this invention to provide an engine which permits almost unlimited choice of materials for manufacture, including wood, or plastics, or casting resins, etc., thereby greatly reducing manufacturing requirements, tasks and expenses.

It is yet a further object of this invention to provide an engine the manufacture of which permits of very broad tolerances of the component parts, thereby greatly reducing the manufacturing costs and the expenses of tooling for said manufacturing process.

It is still a further object of this invention to provide an engine which does not require oil separators, dehydrators, etc., thus further reducing the manufacturing expenses of said engine.

It is yet a further object of this invention to provide an engine which does permit the use of a majority of the working fluids available today, including, but not limited to, gasoline or steam, without danger of "freezing" or siezing of any part of the mechanism due to the working fluid in use.

For better understanding of the present invention together with other and further objects thereof, reference is made to the following description taken in connection with the accompanying drawings and its scope will be pointed out in the appended claims.

DESCRIPTION OF THE PREFERRED EMBODIMENT

Figure 1:
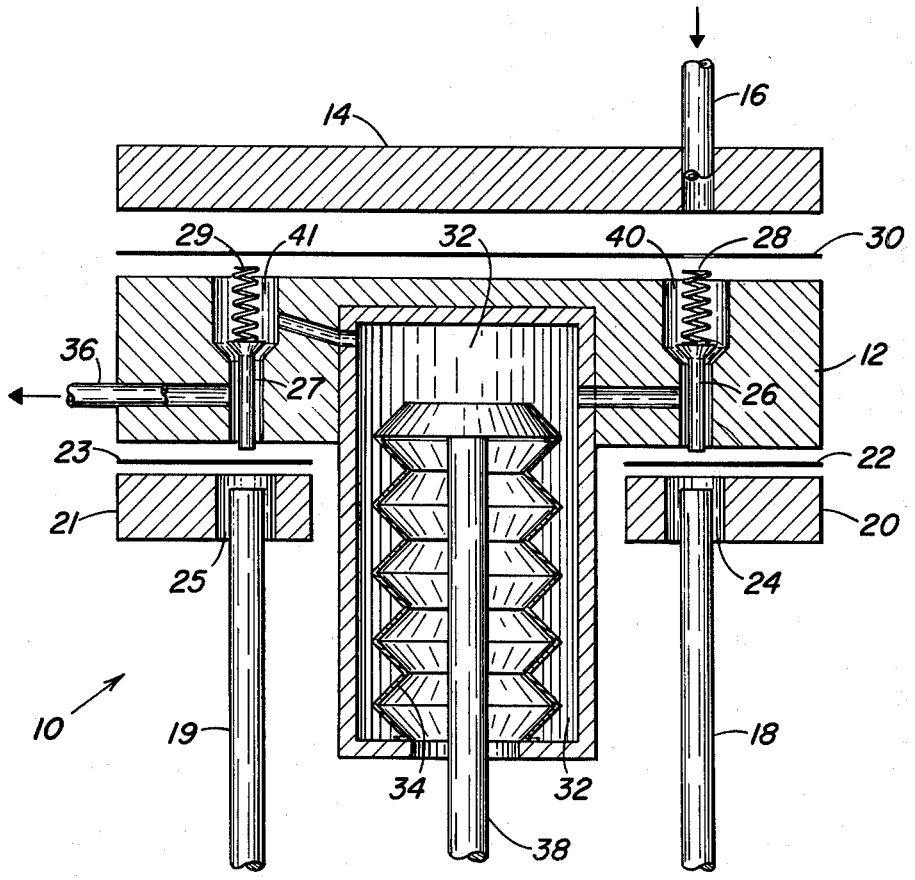
FIG. 1 represents a cutaway view of the engine of this invention, in a quiescent state, with the bellows fully extended

Referring now to FIG. 1, the numeral 10 represents the engine of this invention. The engine 10 is made up of the block 12, the block cover plate 14, intake valve cover plate 20, exhaust valve cover plate 21, and piston rod assembly 38.

The block is made up of bellows/cylinder assembly 34, pressure cavity 32, intake valve chamber 40, exhaust valve chamber 41, intake valve 26 with intake valve spring 28, exhaust valve 27 with exhaust valve spring 29, and exhaust tube 36.

The block cover is made up of block cover plate 14 and its intake tube 16. A suitable means of affixing block cover plate 14 to block 12 is provided, such as through use of bolts, screws, etc., adequate to contain such pressures as will be exhibited in operation of the engine.

The intake valve cover is made up of intake valve cover plate 20 and its intake push rod guide 24. The exhaust valve cover is made up of exhaust valve cover plate 21 and its exhaust push rod guide 25. Suitable means of affixing intake valve cover plate 20 and exhaust valve cover plate 21 to the block 12 is provided, such as through the use of bolts, screws, etc., adequate to contain such pressures as will be exhibited inoperation of the engine.

The piston rod assembly 38 is made up of any suitable rod with an adequate method of affixing same to the top of the bellows. Push rods 18 and 19 are energized to open intake valve 26 and exhaust valve 27, respectively and de-energizing the push rods permits the valves to close by the action of springs 28 and 29 respectly.

Bottom valve-chamber seals 22 and 23 and top valve-chamber seal 30 are fabricated from resilient material and prevent leakage of the working fluid.

MODE OF OPERATION

When it is desired to place the engine 10 in operation, intake valve push rod 18 is energized, entering intake push rod guide 24 and pressing against intake valve-chamber seal 22, pushing valve 26 open against intake valve spring 28. This action admits the working fluid under pressure through intake tube 16, through a hole in top valve-chamber seal 30, into intake valve chamber 40, past intake valve 26 and into pressure cavity 32. At this time it is assumed that exhaust valve 27 is closed. After a sufficient amount of working fluid has been admitted into pressure cavity 32, then intake valve push rod 18 is de-energized, allowing intake valve 26 to close.

The result of the foregoing action is that bellows 34 compresses the top moving downward and moving piston rod assembly 38 downward. When bellows 34 has moved downward the proper amount for the objective to have been accomplished, then it is possible to energize exhaust valve push rod 19, which enters exhaust push rod guide 25 and presses against exhaust valve-chamber seal 23, which in turn moves exhaust valve 27 upward against exhaust valve spring 29, opening exhaust valve 27. This action permits the working fluid to escape from pressure cavity 32, through exhaust valve chamber 41, past exhaust valve 27 and through exhaust tube 36, allowing the bellows 34 to return to the fully extended position. Thus it can be seen, that with suitable accessory equipment, such as, but not limited to, cam shafts, cranks, fly wheels, etc., the type of action desired of the engine 10 can easily be effected.

Although the invention has been described with reference to a particular embodiment, it will be understood to those skilled in the art that the invention is capable of a variety of alternative embodiments within the spirit and scope of the appended claims.

Furthermore it is pointed out, that, although the bellows/cylinder arrangement is depicted in the drawing as cylindrical, the invention is not so limited, another shape, such as for instance, square or triangular, might better fit the optimum functioning of the system. And although the bellows is depicted in the drawing as being used in compression, it is not intended to so limit the invention, since the bellows might well be used in expansion.

I claim:

1. An improved engine comprising:

an engine block having first and second opposed sides;

a cavity formed in the first side of said engine block for confining a working fluid under pressure, said cavity having an aperture in one of its walls;

an axially movable bellows member having a plurality of inwardly directed corrugations positioned within said cavity, said bellows having an extended normal state and an aperture in one of its walls, the bellows aperture sealed to the aperture in said cavity by a sealing means thereby preventing escape of said working fluid from said cavity and providing an opening from the inner portion of said bellows member to the atmosphere;

means for introducing said working fluid into said cavity comprising an intake valve port within said engine block and open to said second side thereof, said port being disposed radially outwardly of said cavity, a first conduit from said valve port projecting exterior of said engine block, a second conduit postioned between said intake valve port and cavity and an intake valve positioned between the first and second intake conduits and having a spring for holding said intake valve in a normally closed position preventing flow into said cavity and operable to an open position against said spring for passing said fluid into said cavity and compressing said bellows member;

means for exhausting said working fluid from said cavity comprising an exhaust valve port within said engine block and open to said second side thereof, said port being disposed radially outwardly of said cavity, a first conduit from said exhaust valve port to said cavity, a second conduit from said exhaust valve port projecting exterior of said engine block and an exhaust valve positioned between said first and second exhaust conduits and having a spring for holding said exhaust valve in a normally closed position preventing the flow of said working fluid from said cavity and operable to an open position against said spring for exhausting said working fluid from said cavity and returning said bellows member to a normal state;

a rod member having a diameter substantially smaller than said apertures attached by attaching means to the inner end surface of said bellows member remote from said apertures projecting external of said engine block through said apertures, said rod member having a first direction of translation while said bellows member is compressing and a second direction of translation when said bellows member is returning to a normal state; and a valve cover plate positioned against said second side of said engine block and over said valve ports and secured to said block by securing means for sealing said valve ports from the atmosphere and supporting said valve springs.

2. The improved engine of claim 1 wherein each of said intake and exhaust valves includes a valve member, and a valve actuator having a juxtaposed relationship with said valve member for selectively compressing said spring and translating said valve member to an open position.

3. The improved engine of claim 2 wherein a seal formed of resilient material is interposed between said valve member and said valve actuator preventing the escape of said working fluid from said port and conduits.

4. The improved engine of claim 3 wherein said cavity is of a dimension substantially greater than said bellows thereby preventing said bellows from having sliding contact with the walls of said cavity when said bellows compresses and extends axially.

* * * * *